United States Patent [19]

Cellers

[11] 4,014,324

[45] Mar. 29, 1977

[54] ROTARY MASSAGING DEVICE AND METHOD OF USING SAME

[76] Inventor: Warren G. Cellers, 127 N. Summit, Arkansas City, Kans. 67005

[22] Filed: Apr. 26, 1976

[21] Appl. No.: 680,517

[52] U.S. Cl. ..... 128/46

[51] Int. Cl.[2] ..... A61H 7/00

[58] Field of Search ..... 128/44–50, 128/56, 24.2, 34–37, 53

[56] References Cited

UNITED STATES PATENTS

| | | | |
|---|---|---|---|
| 782,663 | 2/1905 | Johansen | 128/45 |
| 2,174,452 | 9/1939 | Torrison | 128/36 |
| 2,431,979 | 12/1947 | Amer | 128/46 |
| 2,500,578 | 3/1950 | Sawyer et al. | 128/56 |
| 3,209,748 | 10/1965 | Thomas | 128/53 |

*Primary Examiner*—Lawrence W. Trapp
*Attorney, Agent, or Firm*—Fishburn, Gold & Litman

[57] ABSTRACT

A rotary massaging device for palpating muscle spasms comprising a variable speed power means having a flexible drive shaft operably connected thereto for transmitting rotary motion to a remotely disposed massaging element. The massaging element includes a rigid shaft having one end thereof connected with the flexible drive shaft, the other shaft end being connected coaxially with a disk having a protruding, rounded knob eccentrically affixed thereto being adapted for kneading contact with a patient's skin. The massaging device includes a handle having a central aperture therethrough within which the shaft is rotatably mounted, and an outer handle surface adapted for grasping by the operator's hand. The operator of the device measures the patient's pulse rate, adjusts the rotational speed of the power means to correspond therewith, and applies the massaging head to the patient's skin in the area of the muscle spasm, thereby relieving the discomfort.

8 Claims, 4 Drawing Figures

ROTARY MASSAGING DEVICE AND METHOD OF USING SAME

This invention relates to motor driven appliances for massaging surface portions of the human body and in particular to rotary massaging devices for palpating muscle spasms.

The principal objects of the present invention are: to provide a rotary massaging device whose speed may be varied to correspond to the pulse rate of the patient for improved muscle spasm therapy; to provide such a device having a massaging head which is simple yet effective and efficient in design and which is capable of producing a petrissage action on the deeper muscles and tissues of the body while simultaneously massaging the muscle for increased blood circulation; to provide such a device wherein an inflexible knob is eccentrically affixed to the massaging head and is adapted to contact impressingly the patient's skin and orbitally knead the underlying flesh, whereby the patient is quickly and efficiently treated; and to provide such a device which is economical to manufacture, efficient in use, capable of a long operating life and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Figures 1, 2, 3, 4:
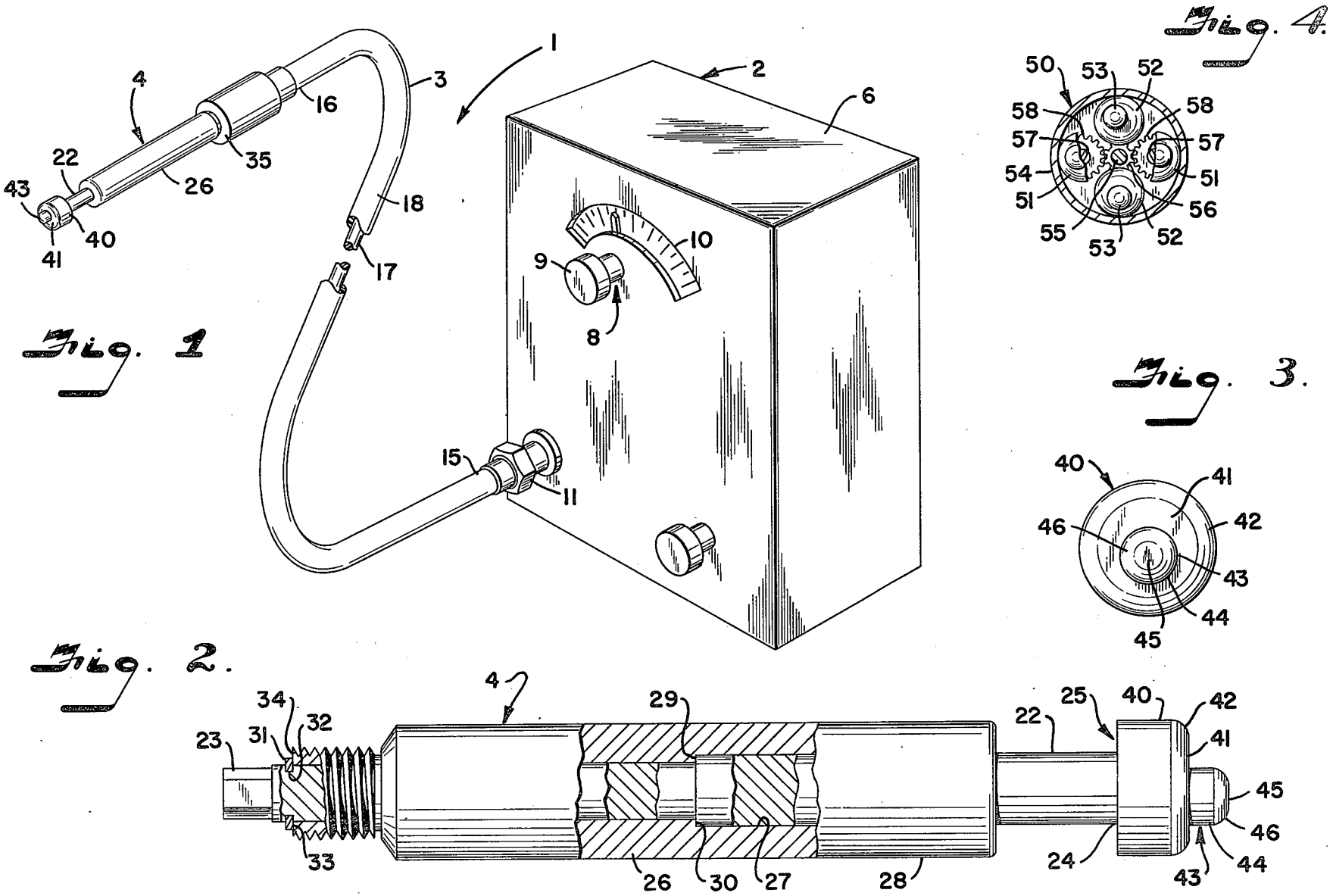
FIG. 1 is a perspective view of a rotary massaging device embodying the present invention with a portion thereof broken away to show the internal structure of the flexible drive shaft.
FIG. 2 is an elevational view of a massaging element, portions of which are broken away to show the various massaging element members.
FIG. 3 is an end elevational view of the massaging element.
FIG. 4 is an end elevational view of another embodiment of the massaging element having a plurality of heads with portions of the same broken away to show various internal members thereof.

Referring more in detail to the drawings:

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a rotary massaging device embodying the present invention, comprising a variable speed motor 2, a power transmission means 3, and a massaging element 4 being operably connected with the other members of the device.

The variable speed motor 2 is illustrated as being a housing 6 enclosing a motor (not shown) and having an output or drive shaft producing rotational motion. The motor is preferably an electric motor having suitable speed and torque. A speed control 8 varies the rotational speed of the device whereby an operator thereof can set said speed to correspond with the pulse rate of the patient. In the illustrated structure, the speed control 8 comprises a rheostat which varies the rotational motor speed within a range of at least 0 to 250 revolutions per minute, in a substantially infinite number of speed settings. Mechanical gear reduction mechanisms (not shown) can also be used to vary the motor's speed as required. In the illustrated structure, the control mechanism 8 includes a selector whereby the user may set the desired rotational speed by manipulating the knob of a needle indicator 9 relative to a stationary arcuate scale 10. The output shaft is adapted for detachably connecting the flexible drive shaft 3 with the rotating power means 2.

The power transmission means 3 has one end 15 thereof operably connected with motor 2 at coupling 11, and the other end 16 is operably connected with the massaging element 4. The transmission means 3, which may be integral with the motor 2 and the massaging element 4 such that the entire device is hand held, is illustrated as comprising a rotating inner core member 17 disposed axially within an outer cover member 18 and being rotationally stationary relative to the core member.

The illustrated massaging element 4 includes a shaft 22 having one end 23 thereof operably connected with the other end 16 of the flexible drive shaft 3, and the other shaft end 24 has connection with a massaging heat 25. A tubular handle member 26, has an axial, central aperture 27 therethrough, wherein the shaft 22 is rotatably mounted. In the illustrated structure, the handle 26 has a circular cross section and an exterior surface 28 which is particularly adapted for grasping by the human hand. Means are provided for restraining relative axial motion between the shaft 22 and the handle 26. In the illustrated structure, the restraining means comprises a shoulder 29 which cooperates abuttingly with a first annular bearing surface 30 within the handle, and a snap ring 31 which matingly engages a slot 32 in the shaft and prevents axial movement by the abutting contact thereof with a second annular bearing surface 33 adjacent the end 34 of the handle. In this example, the handle end 34 is threaded and adapted for engaging an internally threaded portion of a releasable coupling 35 connected with the outer cover member 18 of flexible drive shaft 3. Also, the shaft end 23 is formed in the shape of a hexagon and engages a cooperating female portion of the coupling 35, which in turn has connection with the inner core member 17 of flexible drive shaft 3.

The illustrated massaging head 25 includes an inflexible disk 40 rigidly and coaxially fastened to the forward end 24 of the shaft 22. The disk 40 has a smooth, circular forwardmost surface 41 with a rounded peripheral edge 42 adapted for slidingly rotative, non-depressing contact with the patient's skin. An inflexible knob 43 having a body 44, and a smooth forwardmost surface 45 is rigidly and eccentrically attached to the disk surface 41. The surface of the knob 43 is adapted for orbitally kneading, pressured-impressing contact with the patient's skin, whereby a massaging effect thereon is produced and muscle spasms are relieved. The illustrated body 44 is cylindrical in shape having a flat forwardmost surface 45 and a rounded peripheral edge 46. The relative side of the various massaging head members and the several portions of each is important in attaining the proper massaging effect. In the illustrated structure, the knob 43 protrudes outwardly 11/32 of an inch from disk surface 41 which is 1-3/16 inches in diameter, and is provided with a rounded peripheral edge 46 having a radius in the nature of 5/32 of an inch. Further, the illustrated knob 43 has an outer diameter of ½ inch, and a surface 45 diameter of ¼ inch. The central axes of the disk 40 and knob 43 are parallel and offset, and in this example are offset by a distance in the nature of 1/16 of an inch.

Another embodiment of the present invention, generally designated by the numeral 50, and illustrated in FIG. 4, includes a plurality of rotary massaging heads 51 for additional petrissage action. Each massaging head 51 is substantially identical to the previously described structure and includes a disk 52 with an eccentrically disposed knob 53 therein. In the illustrated device, four massaging heads 51 are rotatively mounted in a cylindrical housing or handle 54. A drive shaft 55 and gear 56 having connection with the rotating power mechanism (not shown) are rotatably mounted in said handle 54 through the central axis thereof. Each massaging head 51 is supported by a shaft 57 having a gear 58 attached to the base thereof and cooperatively engaging the central gear 56. Rotation of the gear 56 induced by the power mechanism, imparts rotation to each massaging head disk 52 thereby orbitally translating each of the knobs 53. The four massaging heads 51 are adapted to simultaneously contact the patient's skin and knead the flesh thereunder thereby relieving muscle spasms and improving blood circulation.

In use, the rotary massaging device 1 is applied to a muscle spasm area of the patient to remove the discomfort therefrom. The user first measures the patient's pulse rate thereby determining the number of arterial pulsations per minute, or other appropriate time period. The rotational speed of variable speed motor 2 is then set by the operator to correspond to the patient's previously determined pulse rate, by manipulating control mechanism 8. The rotational speed of the motor 2 is set to correspond substantialy identically with the patient's pulse rate, such that if the pulse rate of the patient is 80 arterial pulsations per minute, the operator sets the massaging device at a rotational speed of 80 revolutions per minute. The user then applies the massaging head to the muscle spasm, by depressing the knob into the loose portion of the flesh and with surface 41 abutting the area skin in a substantially coplanar fashion thereby acting as a stop or depth guide in the manipulation of the device. The rotary motion produced by the motor 2 and transmitted through flexible drive shaft 3 is imparted to rigid shaft 22 which in turn translates the knob 43 in an orbital pattern thereby providing a petrissage action on the deeper muscles and tissues of the body while simultaneously masaging the muscle for increased blood circulation.

It is to be understood that while I have illustrated and described certain forms of my invention, it is not to be limited to the specific forms or arrangement of parts herein described and shown.

What I claim and desire to secure by Letters Patent is:

1. A rotary massaging device comprising:
a. power means for producing rotary motion;
b. a massaging element including an eccentrically attached knob adapted for orbitally kneading a patient;
c. a rotary power transmission means operably connecting said power means to said massaging element to rotate same; and
d. means for varying the speed of said power means rotary motion whereby an operator of said device sets said speed to correspond with the pulse rate of said patient.

2. A massaging device as set forth in claim 1 wherein:
a. said rotary power transmission means is a flexible shaft with one end connected to the power means and the other end operably connected to the massaging element.

3. A massaging device as set forth in claim 2 including:
a. a massaging element shaft having one end thereof detachably connected with the other end of said flexible drive shaft;
b. a handle having a central axial aperture therethrough wherein sad massaging element shaft is rotatably mounted; said handle having an exterior surface adapted for grasping by a human hand; and
c. a massaging head having connection with the other end of said massaging element shaft.

4. A massaging device as set forth in claim 3 wherein:
a. said massaging head includes a disk coaxially fastened to the other end of said massaging element shaft; said disk being rotated by said power means, and having a smooth forward surface with a rounded peripheral edge adapted for rotational, non-impressing contact with the skin of said patient; and
b. said knob having a body with a smooth forward surface and a rounded peripheral edge marginally therearound; said knob being translated in a circular path relative to said massaging head by said power means and adapted for orbital, impressing contact with the skin of said patient whereby a massaging effect thereon is produced.

5. A massaging device as set forth in claim 4 wherein:
a. said massaging element shaft is rigid;
b. said disk and said knob are substantially inflexible; and
c. said knob is rigidly attached to said disk and said disk is rigidly attached to the other end of said massaging element shaft.

6. A rotary massaging device as set forth in claim 4 wherein:
a. said disk and said knob each have a central axis; and
b. said axes are parallel and spaced apart a distance in the nature of 1/16 of an inch.

7. A rotary massaging device as set forth in claim 6 wherein:
a. said knob has a diameter in the nature of ½ inch;
b. said disk has a diameter in the nature of 1-3/16 inch; and
c. said disk and said knob forward surfaces are substantially parallel and spaced apart a distance in the nature of 11/32 inch.

8. A method of palpating a muscle spasm in a human being to remove discomfort therefrom comprising the steps of:
a. providing a rotary massaging device having a rotating massaging head with a rigid knob fixed rigidly and eccentrically thereon, and means for varying the rotational speed of said massaging head;
b. measuring the pulse rate of the human being;
c. setting the rotational speed of the massaging head to correspond to said pulse rate whereby the number of massaging head revolutions per minute is substantially equal to the number of arterial pulsations per minute; and
d. applying the massaging head to said muscle spasm thereby relieving the discomfort therefrom.

* * * * *